United States Patent [19]

Ohyama

[11] Patent Number: 4,736,716

[45] Date of Patent: Apr. 12, 1988

[54] COOLING SYSTEM FOR A TWO STROKE ENGINE

[75] Inventor: Kazuo Ohyama, Saitama, Japan

[73] Assignee: Honda Giken Kogyo Kabushiki Kaisha, Tokyo, Japan

[21] Appl. No.: 22,487

[22] Filed: Mar. 6, 1987

Related U.S. Application Data

[63] Continuation of Ser. No. 684,198, Dec. 18, 1984, abandoned.

[30] Foreign Application Priority Data

Dec. 19, 1983 [JP] Japan ..... 58-237821

[51] Int. Cl.[4] ..... F01P 3/02

[52] U.S. Cl. ..... 123/65 A; 123/41.78

[58] Field of Search ..... 123/41.78, 65 A, 65 W

[56] References Cited

U.S. PATENT DOCUMENTS

| | | | |
|---|---|---|---|
| 1,688,076 | 10/1928 | Grayson | 123/41.78 |
| 2,123,065 | 7/1938 | Sass | 123/41.78 |
| 2,627,255 | 2/1953 | Kiekhaefer | 123/41.78 |
| 2,820,441 | 1/1958 | Scheiterlein et al. | 123/41.78 |
| 2,966,900 | 1/1961 | Ehrlich | 123/65 A |
| 2,989,953 | 6/1961 | Kessler et al. | 123/41.78 |

FOREIGN PATENT DOCUMENTS

| | | |
|---|---|---|
| 27021 | 3/1981 | Japan . |
| 27022 | 3/1981 | Japan . |
| 59628 | 12/1982 | Japan . |

*Primary Examiner*—William A. Cuchlinski, Jr.
*Attorney, Agent, or Firm*—Lyon & Lyon

[57] ABSTRACT

A cooling system for a two-stroke engine including a water jacketed cylinder having cooling passages located beneath the exhaust port and beneath the transfer ports in the cylinder wall. Liquid coolant flows upwardly from the crankcase structure into the cylinder wall cooling jacket and finally upwardly into the head.

3 Claims, 4 Drawing Sheets

FIG. 5.
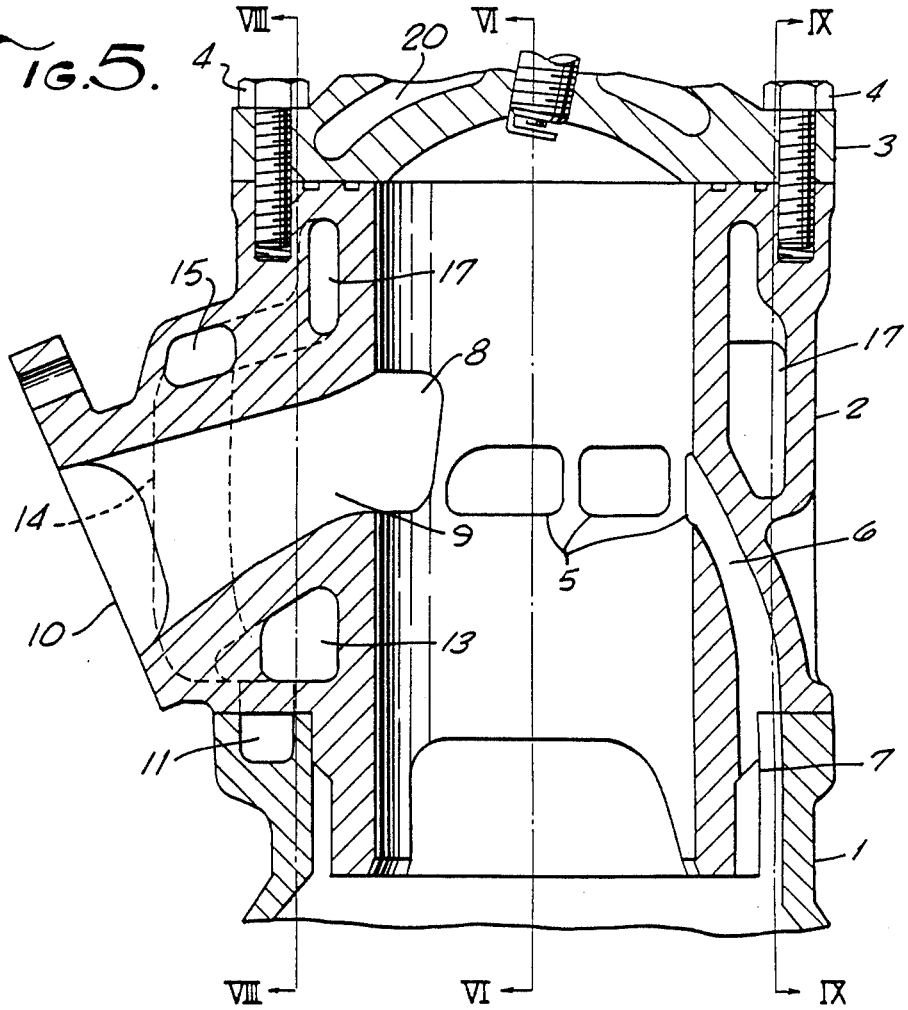
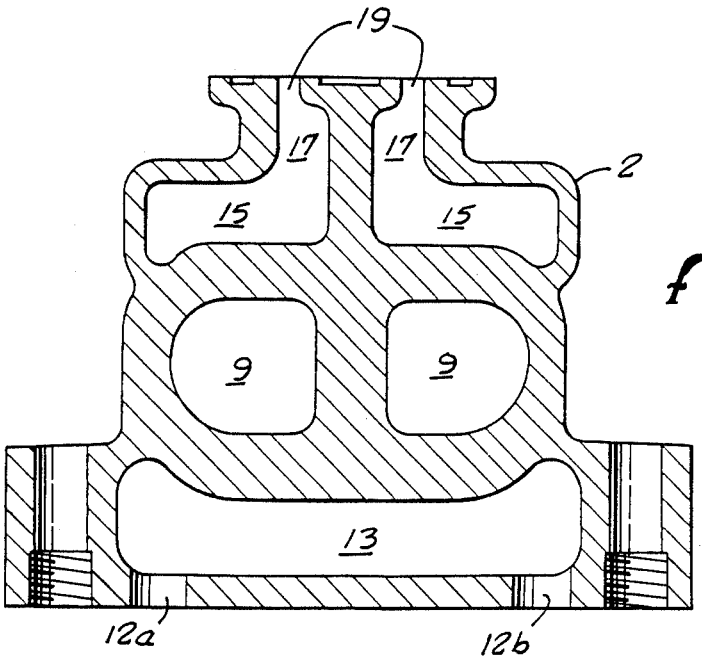
FIG. 8.

COOLING SYSTEM FOR A TWO STROKE ENGINE

This application is continuation of application Ser. No. 684,198, filed Dec. 18, 1984, now abandoned.

BACKGROUND OF THE INVENTION

The field of the invention is two-stroke internal combustion engines and the invention is particularly directed to a system for cooling a two-stroke engine.

In two-stroke engines of the prior art which have employed flowing coolant systems, coolant has only been circulated through the cylinder head and upper portions of the cylinder walls. Thus the piston surface was only cooled during the portion of the stroke when it was in close proximity to the cooled surfaces in the upper portion of the cylinder.

In engines of this type, higher efficiency of operation may be obtained through additional cooling of the piston surface.

SUMMARY OF THE INVENTION

The present invention is directed to providing enhanced cooling of the piston in a two-stroke engine. To this end, passages are provided within the cylinder walls in the lower portion of the cylinder through which a coolant flows to carry away heat generated by the operation of the engine. By this invention additional cooling is provided in the area near the bottom of the cylinder. The piston may be cooled during the portion of the engine stroke when it is in close proximity to the cooled surfaces in the bottom of the cylinder as well as during the rest of the stroke.

Accordingly, it is an object of the present invention to provide enhanced cooling of the piston and cylinder of a two stroke internal combustion engine.

An object of an additional feature of the present invention is to provide a smooth and continuous flow of coolant from a coolant source for smoother, more continuous and more reliable cooling of the cylinder assembly. To that end, the coolant may be taken directly from a reservoir through passages in the base of the cylinder, and up into the cylinder.

Other and further objects and advantages will appear hereinafter.

BRIEF DESCRIPTION OF THE DRAWINGS

FIG. 5 is a cross-sectional view of a cylinder assembly employing the present invention.

FIG. 8 is a cross-sectional view of a cylinder assembly according to the present invention taken along the line VIII—VIII of FIG. 5.

DETAILED DESCRIPTION OF THE PREFERRED EMBODIMENT

Figure 1:
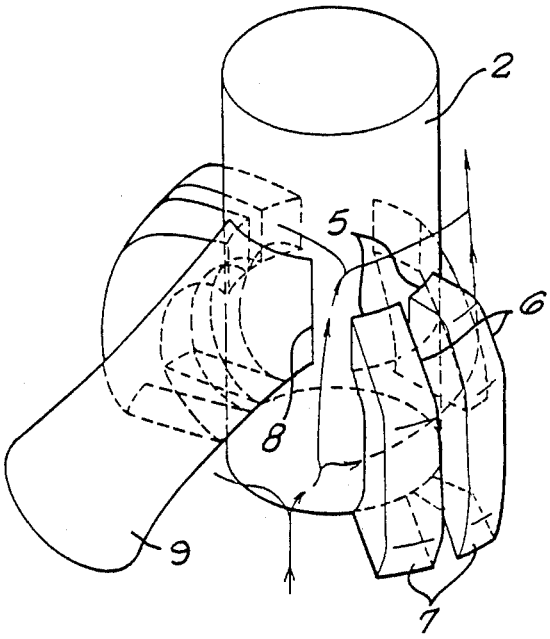
FIG. 1 is a perspective schematic view of a two-stroke internal combustion engine cylinder employing the present invention.

Turning in detail to the drawings, FIG. 1 illustrates a cylinder 2 with an exhaust port 8 connected to an exhaust passage 9 and transfer ports 5 connected to transfer passages 6 with openings 7 therein. The transfer ports and passages are used, for example, in the air scavenging operation as is well known in the prior art.

Figure 2:
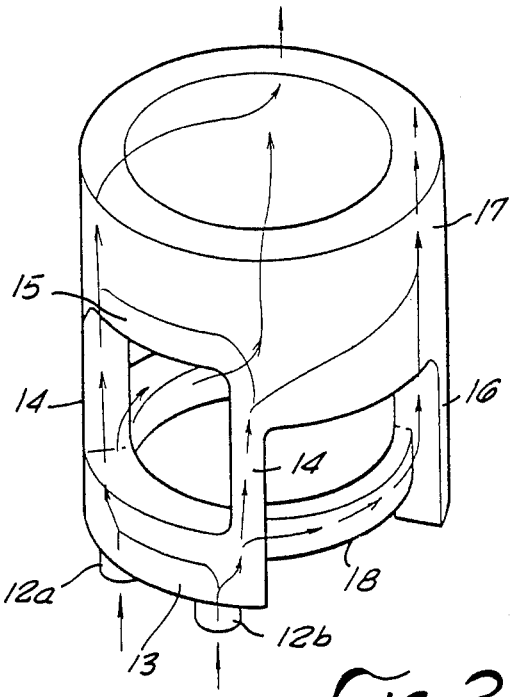
FIG. 2 is another perspective schematic view of the cylinder of FIG. 1.

FIG. 2 illustrates the cylinder wall according to the present invention. Coolant from a coolant supply is pumped by a pump means into coolant input holes 12*a* and 12*b*. Coolant then flows through coolant passage 13 located below the exhaust port 8 and coolant passages 18 located below the respective transfer ports 5. Coolant is then pumped upward through passages 14, located laterally adjacent to the exhaust port 8, and through passages 16 located laterally adjacent and intermediate the respective transfer ports 5. Part of the coolant circulates from the passages 14 through passage 15 located adjacent the top of the exhaust port 8. The remainder of the coolant from the passages 14 joins with coolant from the passages 16 to circulate. Around the upper portion of the cylinder and up toward the cylinder head through passages 17 that form the principal part of the cylinder water jacket.

Figure 3:
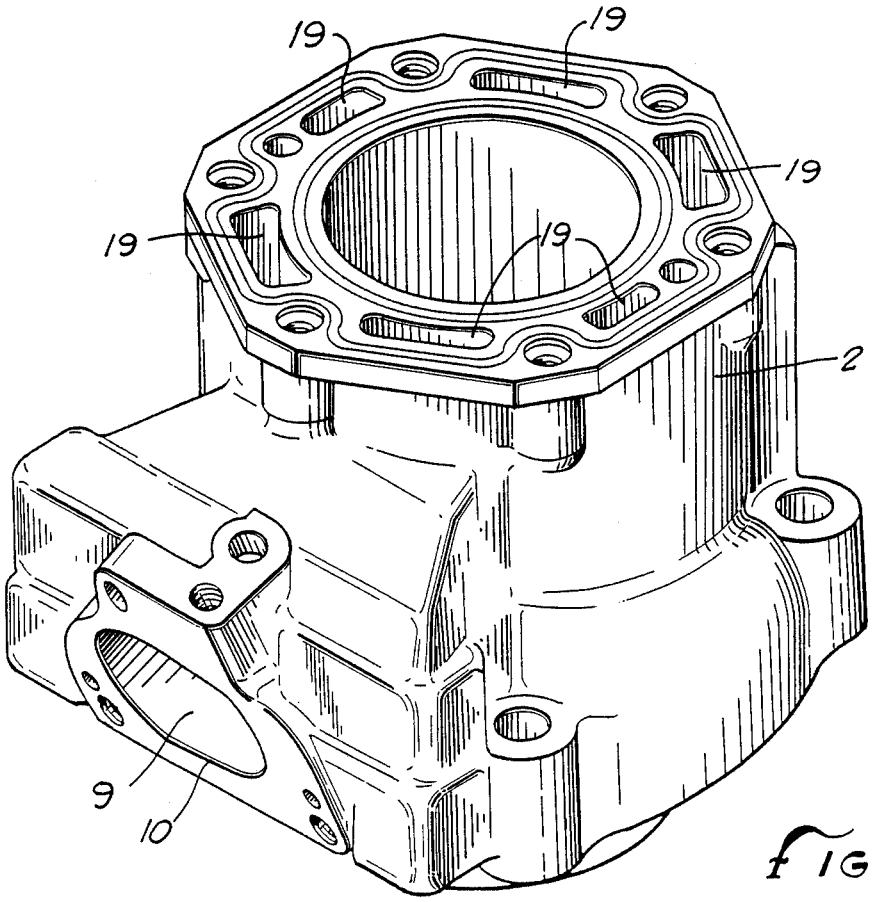
FIG. 3 is a perspective view of a cylinder assembly employing the present invention.
Figure 4:
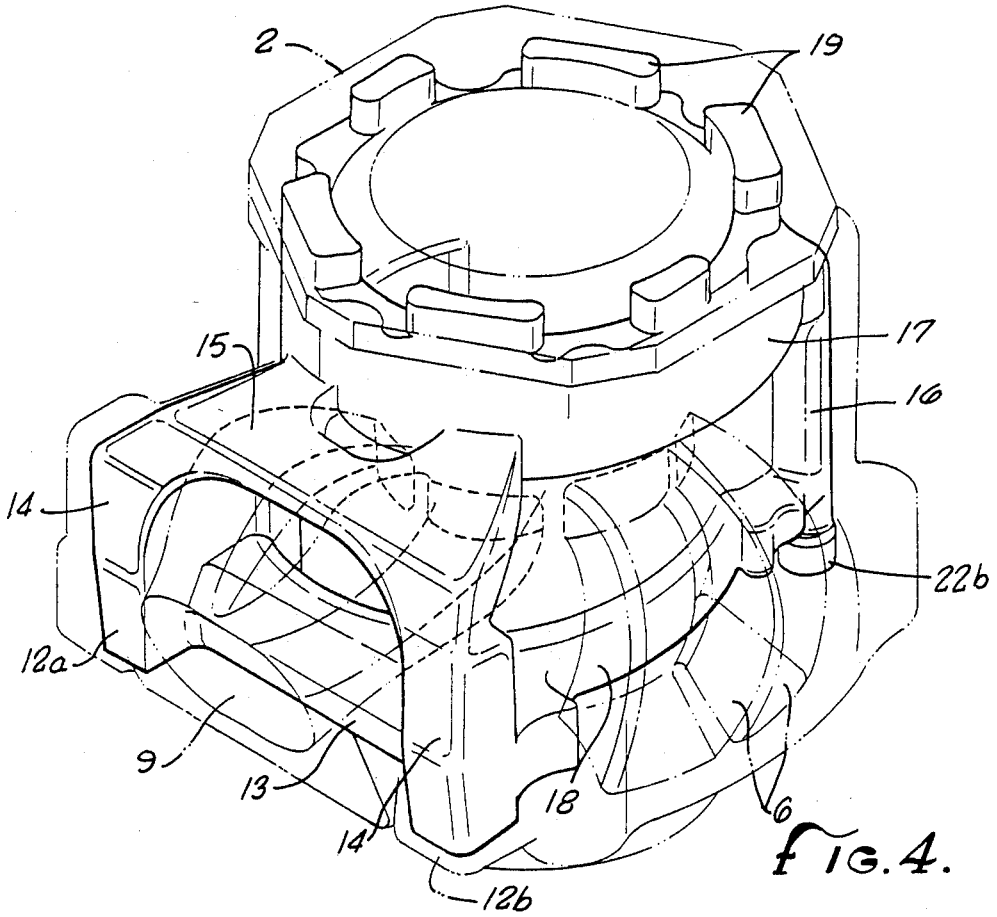
FIG. 4 is a perspective view of a cylinder assembly in phantom employing the present invention and detailing the locations of ports and passages within the cylinder wall in full line.
Figure 7:
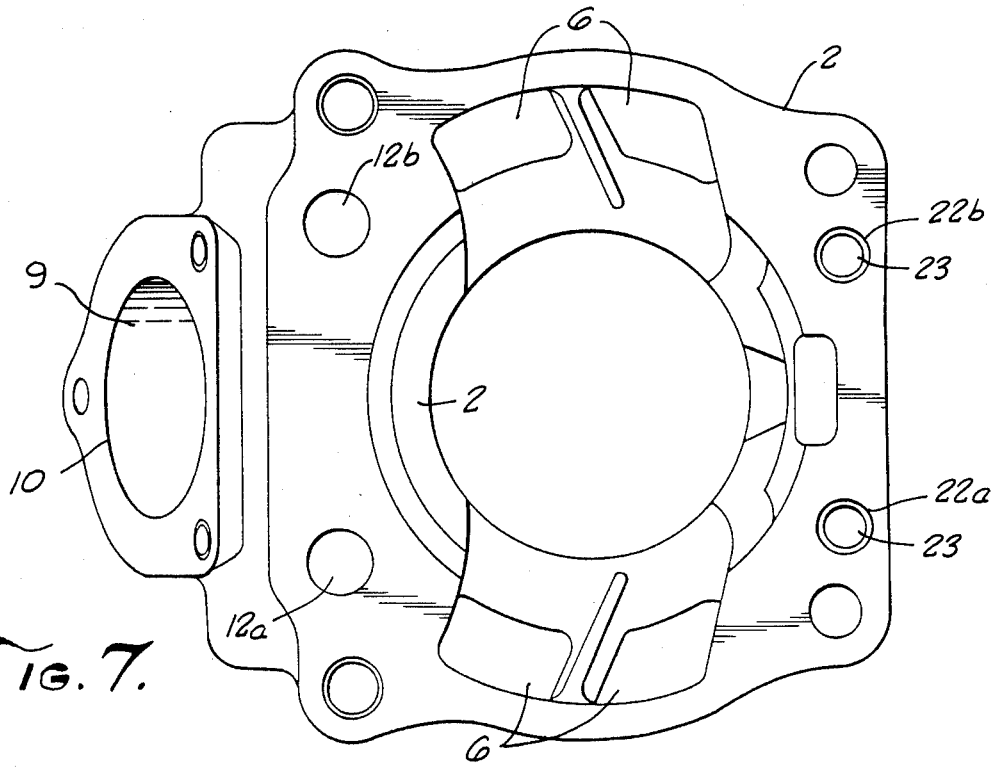
FIG. 7 is a bottom plan view of a cylinder assembly according to the present invention.
Figure 6:
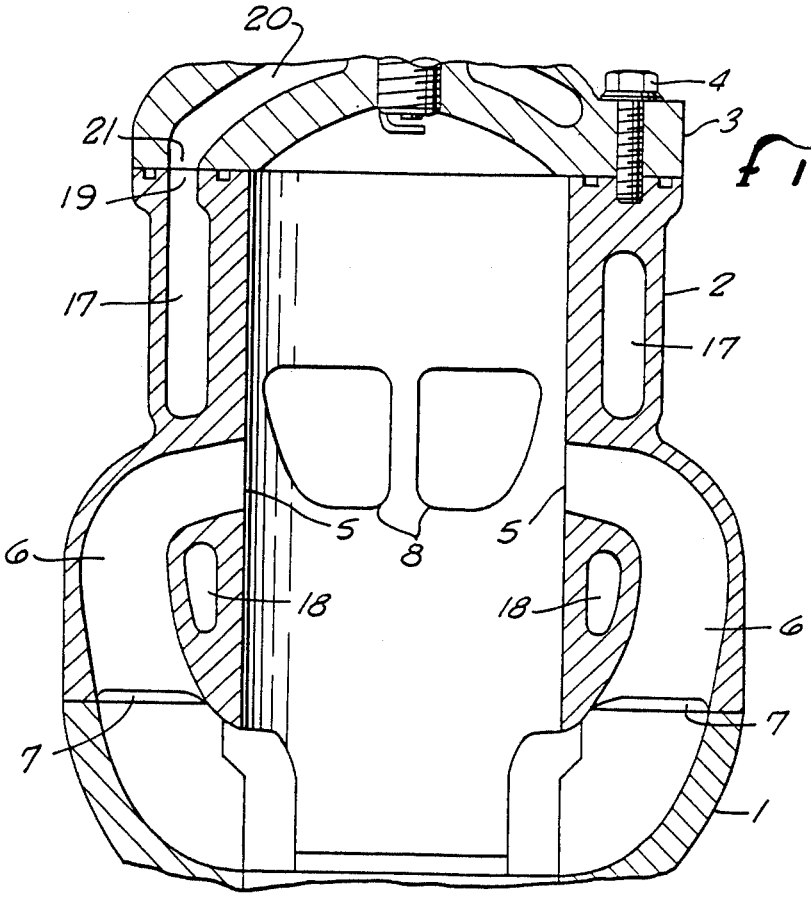
FIG. 6 is a cross-sectional view of a cylinder assembly according to the present invention taken along the line VI—VI of FIG. 5.
Figure 9:
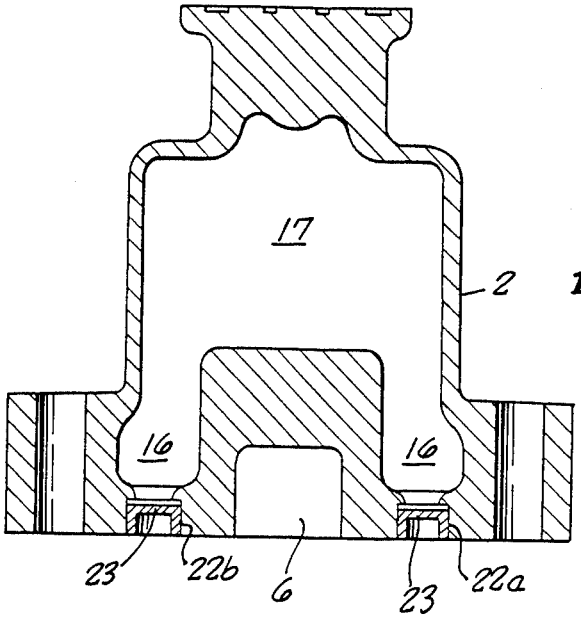
FIG. 9 is a cross-sectional view of a cylinder according to the present invention taken along the line IX—IX of FIG. 5.

FIG. 3 illustrates coolant exhaust outlets 19 located in the top of the cylinder wall. Coolant passes from passages 17, through the outlets 19 and into the engine head. The cylinder head 3 is best illustrated in FIGS. 5 and 6. From the outlets 19, coolant passes into connecting holes 21 and then into the cylinder head coolant passage 20 in the cylinder head 3 at the top of the cylinder. Coolant is then passed out of coolant outlets in the cylinder head 3 and through a connecting means back to a coolant reservoir to complete the cycle.

In two-stroke internal combustion engines, the upper surface of the piston, which forms a part of the combustion chamber, becomes hot in operation. In engines of the prior art, cooling from a flowing coolant system is only provided in the upper portion of the cylinder and therefore the hot piston is only cooled when it is in close proximity to the cylinder head and upper portion of the cylinder wall, e.g., during the latter portion of the compression stroke, the detonation, and the initial portion of the exhaust stroke. As a result, the upper surface of the piston is not optimally cooled and heat is retained in the upper surface of the piston. This retained heat causes the air/ fuel mixture which fuels the engine to be prematurely heated during the scavenging portion of the cycle when the upper surface of the piston is at its furthest point from the cooling surfaces of the cylinder head and upper portions of the cylinder wall.

Two-stroke engines of the prior art typically do not provide a coolant system in the lower portion of the cylinder assembly. The present invention provides coolant passages 13 and 18 in the lower portion of the cylinder 2 which are in close proximity to and located below the exhaust port 8 and the transfer ports 5. The passage 18 circumferentially encompasses the cylinder below the transfer ports 5. The passage 13 is located below the exhaust port 8. Thus increased cooling is provided to the piston and cylinder below the exhaust port 8 and below the transfer ports 5 resulting in a more uniform cooling of the piston throughout the entire engine cycle and greater efficiency of operation for the engine is obtained.

A further object of the present invention is the provision of a smoother flow of and more continuous and reliable supply of coolant to the cylinder. To this end, coolant provided to the cylinder through inlets 12*a* and 12*b* has as its source the coolant supply in the crankcase of the engine located beneath the cylinder assembly.

In the preferred embodiment of this system the coolant comprises water, ethylene glycol, a mixture of water and ethylene glycol, or one of a number of suitable liquid coolants as are well known in the prior art.

Thus, a coolant system is disclosed which provides enhanced cooling to the cylinder and piston of a two-stroke internal combustion engine as well as a smoother, more continuous and more reliable flow of coolant. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. In combination, a cylinder defining a combustion chamber for a two-stroke internal combustion engine, a piston reciprocable in said cylinder, at least two mutually opposed transfer ports and at least one exhaust port circumferentially spaced from said transfer ports penetrating the wall of said cylinder to communicate with said combustion chamber, and a liquid coolant conducting system in the wall of said cylinder for cooling said cylinder, comprising:

a first coolant passage directly below said exhaust port and extending transversely thereof;

second coolant passages directly below said transfer ports and extending transversely thereof;

means defining a coolant jacket concentrically about said cylinder wall effective to cool said piston throughout the full stroke thereof;

upwardly extending laterally spaced coolant passages on opposite sides of said exhaust port connecting said first coolant passage and said coolant jacket;

a pair of coolant inlets communicating with said first coolant passage closely adjacent said upwardly extending coolant passages for directing coolant supplied to said system divergently to said upwardly extending coolant passages and said first coolant passage; and at least one coolant outlet from the top of said coolant jacket.

2. The combination of claim 1 wherein said coolant outlet extends circumferentially about said coolant jacket.

3. The combination of claim 1 wherein said second coolant passages communicate with said upwardly extending coolant passages.

* * * * *